US010435975B2

(12) United States Patent
Greenwood et al.

(10) Patent No.: US 10,435,975 B2
(45) Date of Patent: Oct. 8, 2019

(54) MECHANICAL FORCE GENERATOR

(71) Applicant: FLEXIDRILL LIMITED, Auckland (NZ)

(72) Inventors: Roland Greenwood, Victoria (AU); Owen Schicker, Timaru (NZ)

(73) Assignee: FLEXIDRILL LIMITED, Auckland (NZ)

( * ) Notice: Subject to any disclaimer, the term of this patent is extended or adjusted under 35 U.S.C. 154(b) by 120 days.

(21) Appl. No.: 15/319,689

(22) PCT Filed: Jun. 16, 2015

(86) PCT No.: PCT/IB2015/054529

§ 371 (c)(1),
(2) Date: Dec. 16, 2016

(87) PCT Pub. No.: WO2015/193799

PCT Pub. Date: Dec. 23, 2015

(65) Prior Publication Data

US 2017/0152720 A1 Jun. 1, 2017

(30) Foreign Application Priority Data

Jun. 17, 2014 (NZ) ..... 626358

(51) Int. Cl.
*E21B 28/00* (2006.01)
*E21B 7/24* (2006.01)
(Continued)

(52) U.S. Cl.
CPC ..... *E21B 28/00* (2013.01); *E21B 4/16* (2013.01); *E21B 7/24* (2013.01); *E21B 25/00* (2013.01); *E21B 7/046* (2013.01); *E21B 31/005* (2013.01)

(58) Field of Classification Search
CPC ... E21B 4/003; E21B 4/06; E21B 4/16; E21B 7/24; E21B 28/00; E21B 31/005; E21B 10/22; E21B 10/54
See application file for complete search history.

(56) References Cited

U.S. PATENT DOCUMENTS 1,901,513 A * 3/1933 Harris ..... A47J 36/04 175/298
2,153,883 A * 4/1939 Poster ..... E21B 4/10 173/205
(Continued)

FOREIGN PATENT DOCUMENTS

CA 2828675 A1 * 9/2012 ..... E21B 4/10
CA 2836699 A1 * 11/2012 ..... E21B 31/005
(Continued)

OTHER PUBLICATIONS

The Free Dictionary.com, "Rotatable", 2019, 1 page (Year: 2019).*
(Continued)

*Primary Examiner* — Jennifer H Gay
(74) *Attorney, Agent, or Firm* — Studebaker & Brackett PC

(57) ABSTRACT

Disclosed is a mechanical force generator for use in a drillstring that provides a sinusoidal or near sinusoidal oscillating output, comprising: a rotatable cam plate connected to a mass, the cam plate having two opposed oblique bearing surfaces rotatable through a bearing, wherein upon rotation, the two opposed oblique bearing surfaces cam against the bearing to oscillate the mass longitudinally, wherein the bearing comprises opposing bearings for bearing against the opposed oblique bearing surfaces and wherein at least one bearing adjusts to follow the respective opposed bearing surface and maintain engagement.

18 Claims, 10 Drawing Sheets

(51) Int. Cl.

| | |
|---|---|
| ***E21B 4/16*** | (2006.01) |
| ***E21B 25/00*** | (2006.01) |
| ***E21B 7/04*** | (2006.01) |
| ***E21B 31/00*** | (2006.01) |

(56) References Cited

U.S. PATENT DOCUMENTS 2,221,242 A * 11/1940 McCielland ..... E21B 10/00 175/227
2,554,005 A * 5/1951 Bodine, Jr. ..... E21B 7/24 173/49
2,742,265 A * 4/1956 Snyder ..... E21B 4/10 175/295
3,637,032 A * 1/1972 Jeter ..... E21B 7/06 175/73
4,261,425 A * 4/1981 Bodine ..... E21B 4/006 175/106
4,662,267 A * 5/1987 Kaku ..... B21K 1/76 417/269
4,734,014 A * 3/1988 Ikeda ..... F02M 37/08 417/269
5,307,886 A * 5/1994 Hopper ..... E21B 4/10 166/289
6,287,087 B1 * 9/2001 Fukushima ..... F04B 27/0886 403/230
6,364,034 B1 * 4/2002 Schoeffler ..... E21B 4/006 175/101
7,419,018 B2 * 9/2008 Hall ..... E21B 4/06 175/106
8,517,093 B1 * 8/2013 Benson ..... E21B 1/00 166/249
8,646,981 B2 * 2/2014 Peterson ..... F16C 17/06 384/306
8,789,281 B1 * 7/2014 Sexton ..... E21B 4/02 29/898.041
8,840,309 B2 * 9/2014 Cooley ..... F16C 17/03 384/306
8,967,871 B2 * 3/2015 Peterson ..... F16C 17/06 384/306
8,967,872 B2 * 3/2015 Peterson ..... F16C 17/06 384/306
9,045,957 B2 * 6/2015 Yajure ..... E21B 7/24
9,316,100 B2 * 4/2016 Benson ..... E21B 47/00
9,322,237 B2 * 4/2016 Schicker ..... E21B 4/10
9,429,188 B2 * 8/2016 Peterson ..... F16C 17/06
2008/0017419 A1 * 1/2008 Cooley ..... B23B 27/12 175/286
2008/0099245 A1 * 5/2008 Hall ..... E21B 4/06 175/57
2009/0268995 A1 * 10/2009 Ide ..... E21B 4/003 384/121
2011/0100716 A1 * 5/2011 Shepherd ..... A61F 13/15747 175/73
2011/0174544 A1 * 7/2011 Scott ..... E21B 4/003 175/92
2011/0284292 A1 * 11/2011 Gibb ..... E21B 7/04 175/61
2012/0037425 A1 * 2/2012 Sexton ..... E21B 4/003 175/57
2012/0228875 A1 * 9/2012 Hardin, Jr. ..... E21B 41/0085 290/52
2012/0281938 A1 * 11/2012 Peterson ..... F16C 17/06 384/306
2013/0146360 A1 * 6/2013 Yajure ..... E21B 7/24 175/55
2013/0182980 A1 * 7/2013 Peterson ..... F16C 17/06 384/306
2013/0192899 A1 * 8/2013 Cooley ..... F16C 17/03 175/92
2014/0054090 A1 * 2/2014 Schicker ..... E21B 4/10 175/95
2014/0105739 A1 * 4/2014 Peterson ..... F16C 17/06 415/229
2014/0110178 A1 * 4/2014 Savage ..... E21B 47/02 175/76
2015/0167732 A1 * 6/2015 Peterson ..... F16C 17/06 415/229
2015/0260031 A1 * 9/2015 Benson ..... E21B 1/00 175/40
2016/0130898 A1 * 5/2016 Solem ..... E21B 28/00 166/177.6
2016/0194917 A1 * 7/2016 Alali ..... E21B 7/24 175/322
2017/0152720 A1 * 6/2017 Greenwood ..... E21B 7/24
2017/0226806 A1 * 8/2017 Nguyen ..... E21B 7/24
2018/0016846 A1 * 1/2018 Peter ..... E21B 4/003
2018/0058145 A1 * 3/2018 Tutt ..... E21B 1/00
2018/0080284 A1 * 3/2018 Prill ..... E21B 7/24

FOREIGN PATENT DOCUMENTS

CA 2981114 A1 * 10/2016 ..... E21B 4/003
EP 0919719 A2 6/1999
EP 3228809 A1 * 10/2017 ..... E21B 7/067
GB 2455734 A * 6/2009 ..... A61F 13/15747
WO WO-2012002939 A1 * 1/2012 ..... E21B 4/003
WO 2012/120403 A1 9/2012
WO WO-2012120403 A1 * 9/2012 ..... E21B 4/10

OTHER PUBLICATIONS

International Search Report issued in PCT/IB2015/054529; dated Oct. 6, 2015.
Written Opinion issued in PCT/IB2015/054529; dated Oct. 6, 2015.
International Preliminary Report on Patentability issued in PCT/IB2015/054529; dated Jul. 7, 2016.

* cited by examiner

MECHANICAL FORCE GENERATOR

FIELD OF INVENTION

The present invention relates to mechanical force generators and/or their use in drilling apparatus to provide vibration during drilling.

BACKGROUND

In bore drilling (including extended reach (horizontal drilling) applications) there is often a need to provide a drilling apparatus with a drill string (whether jointed drill rods, or continuous coil tube) containing a vibratory device that provides a level of axial excitation to minimise the frictional forces, which can dramatically slow or stop a drilling or re-entry operation. In addition, such a vibratory device can be beneficial to help free drill strings once they have become stuck.

Often such vibratory devices are difficult to manufacture.

SUMMARY OF INVENTION

It is an object of the present invention to provide a mechanical force generator for a drilling apparatus to assist with drilling, and/or a drilling apparatus with a mechanical force generator, or at least to provide the public with a useful choice.

The mechanical force generator described can be used in any drilling apparatus or other drilling application where vibrational force is desirable.

In one aspect the present invention may be said to consist in a mechanical force generator for use in a drillstring that provides a sinusoidal or near sinusoidal oscillating output, comprising: a rotatable cam plate connected to oscillate a mass to indirectly provide oscillations to the drillstring and/or a housing of the drillstring, the cam plate having two opposed oblique bearing surfaces rotatable through a bearing, wherein upon rotation, the two opposed oblique bearing surfaces cam against the bearing to oscillate the mass longitudinally relative to the drillstring and/or the housing of the drill string, the oscillations being transferred to the drill string and/or drillstring housing, wherein the bearing comprises opposing bearings for bearing against the opposed oblique bearing surfaces and wherein at least one bearing adjusts to follow the respective opposed bearing surface and maintain engagement.

In one aspect the present invention may be said to consist in a mechanical force generator for use in a drillstring that provides a sinusoidal or near sinusoidal oscillating output, comprising: a rotatable cam plate connected to oscillate a mass to indirectly provide oscillations to the drillstring and/or a housing of the drillstring, the cam plate having two opposed oblique bearing surfaces rotatable through a bearing, the bearing comprising at least one opposing knuckle bearing for each opposed oblique bearing surface, each knuckle bearing comprising a socket and corresponding bearing element with a first slidable bearing surface within the socket, and a second slidable bearing surface that bears against a corresponding opposed bearing surface, wherein upon rotation, the two opposed oblique bearing surfaces cam against the bearing to oscillate the mass longitudinally relative to the drillstring and/or the housing of the drill string, the oscillations being transferred to the drill string and/or drillstring housing.

Preferably for each knuckle bearing, the bearing element pivots in the socket so the second slidable bearing surface follows and maintains engagement against the opposed oblique bearing surface during rotation.

Preferably the mechanical force generator further comprises a rotary input shaft for rotating the cam plate.

Preferably the opposed oblique bearing surfaces are parallel and arranged non-perpendicular to the longitudinal axis of the rotary input shaft such that the longitudinal displacement of each opposed surface with respect to the axis varies across the surface.

Preferably the opposed bearing surfaces are flat.

Preferably the cam plate comprises a flat plate with opposed parallel surfaces to form the oblique bearing surfaces, the cam plate being coupled to the shaft at an angle such that the opposed oblique bearing surfaces are arranged non-perpendicular to the longitudinal axis of the shaft.

Preferably the cam plate comprises opposed parallel surfaces formed at an oblique angle to form the oblique bearing surfaces such that the opposed oblique surfaces are non-perpendicular to the longitudinal axis of the shaft.

Preferably the socket and/or bearing element are formed from Poly Crystalline Diamond (PCD).

Preferably the socket is concave and the first slidable bearing surface is correspondingly convex.

Preferably the back and forth movement of the mass transfers a force to an outer casing via thrust bearings, which can be or comprise the knuckle bearings.

Preferably as the cam plate rotates, it slides against the bearing and the bearing element swivels in the socket so that each knuckle bearing maintains contact with a corresponding oblique bearing surface.

Preferably the interface between the socket and bearing element is lubricated with drilling fluid.

In another aspect the present invention may be said to consist in a drillstring and/or drilling apparatus comprising a mechanical force generator according to any described above.

In another aspect the present invention may be said to consist in a core sampling drilling sub-assembly for a core sample drilling apparatus comprising: a housing for coupling to a drill string, comprising a removable coring sub-assembly comprising: a mechanical force generator, a rotational apparatus to operate the mechanical force generator, and a core barrel, and a coupling for receiving and engaging an extraction sub-assembly to remove the coring sub-assembly from the housing.

In another aspect the present invention may be said to consist in a core sample drilling apparatus comprising: a drill string, a core sampling drilling sub-assembly coupled to the drillstring.

In another aspect the present invention may be said to consist in a wireline logger sub-assembly for a drilling apparatus comprising: a housing for coupling to a drill string, a mechanical force generator, and a rotational apparatus, logging apparatus, and a wireline logging apparatus, wherein said rotational apparatus is an electric motor and the wireline is a conductor and conveys electrical power to operate the electric motor.

Preferably the mechanical force generator is used in a drill string for one or more of the following applications:

tractoring into a bore,
extended reach drilling,
shifting valves,
setting plugs,
setting screens,
sand control in screens,
high pressure high temperature applications,
stirling engine pump, milling
scale removal
cementing
core sampling,
drilling,
fishing for stuck tools, and/or
wire lines.

In this specification where reference has been made to patent specifications, other external documents, or other sources of information, this is generally for the purpose of providing a context for discussing the features of the disclosure. Unless specifically stated otherwise, reference to such external documents is not to be construed as an admission that such documents, or such sources of information, in any jurisdiction, are prior art, or form part of the common general knowledge in the art.

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting. Where specific integers are mentioned herein which have known equivalents in the art to which this invention relates, such known equivalents are deemed to be incorporated herein as if individually set forth. The invention consists in the foregoing and also envisages constructions of which the following gives examples only.

As used herein "and/or" means "and" or "or", or both, to the extent the context allows.

As used herein "(s)" following a noun means either or both the singular and/or plural of the noun.

As used in herein "sinusoidal" includes true sinusoidal and near sinusoidal.

As used herein "sinusoidal character" includes a surface or profile sufficiently characterised to cam the rollers or other followers to provide a sinusoidal output.

As used herein "sinusoidal output" includes a true or near sinusoidal output not characterised as solely an impact output.

A preferred form of the present invention will now be described with reference to the accompanying drawings in which

BRIEF DESCRIPTION OF THE DRAWINGS

Preferred embodiments of the drawings will now be described with reference to the drawings, of which

DETAILED DESCRIPTION OF PREFERRED EMBODIMENTS

Mechanical Force Generator Embodiment

Figure 1:
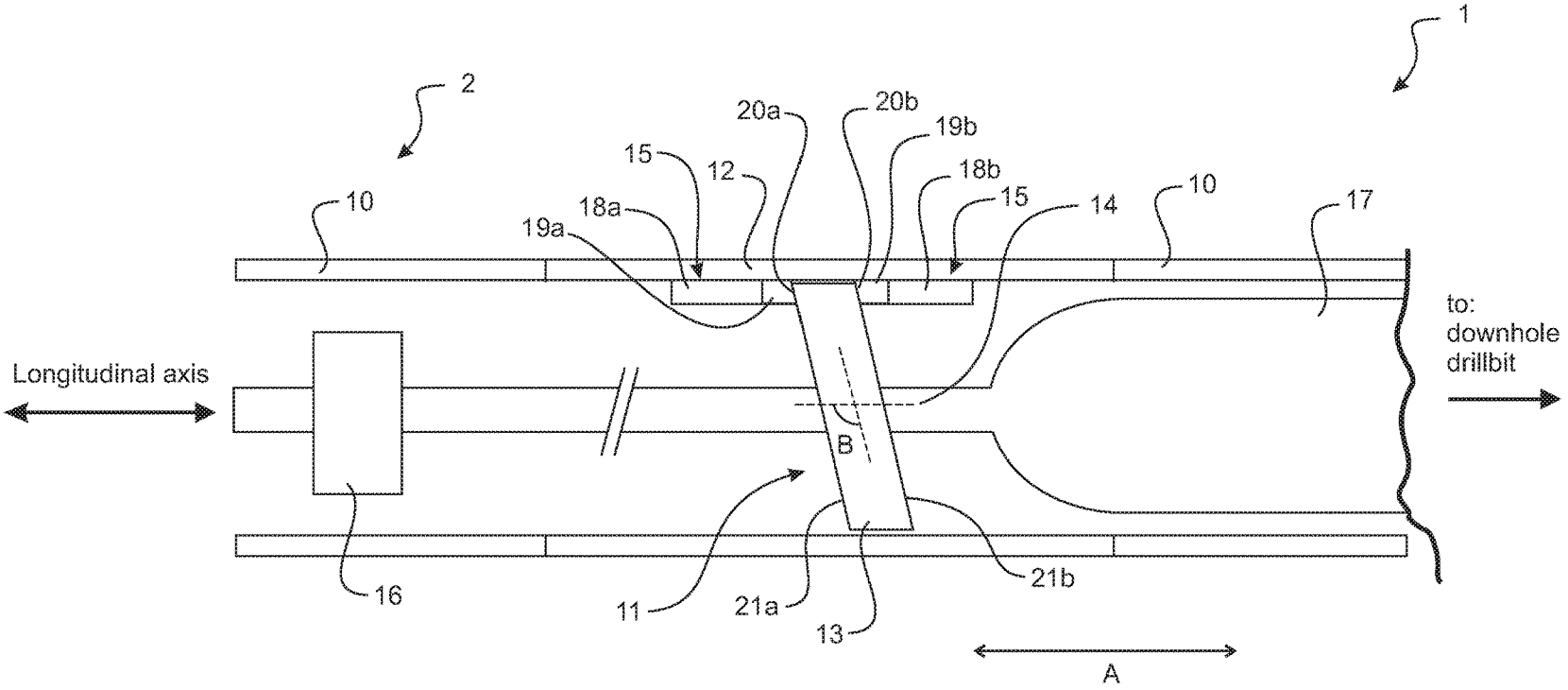
FIG. 1 shows a general form of a mechanical force generator in a drill string according to the present invention.

FIG. 1 shows in general form a portion of a drill string 2 of a drilling apparatus 1, with a mechanical force generating apparatus (mechanical force generator) 11 assembled therewith in accordance with the invention. The mechanical force generating apparatus (also termed a vibratory apparatus or device) can oscillate "A" the drillstring longitudinally during drilling operations to assist with drill speed and depth, to prevent seizure of drilling and/or to release drill strings that have become seized and/or stuck during drilling and/or while downhole. The mechanical force generator may assist with minimising friction and/or enhancing drill speed during operations.

Referring to FIG. 1, the drilling apparatus 1 comprises a drillstring 2 with a longitudinal axis. It has a housing/casing 10 and a mechanical force generator 11 connected to it. Other aspects of a drilling apparatus will be known to those skilled in the art. The force generator 11 preferably comprises an outer tubular housing 12 which is connected to the drill housing 10, and is advanced/pulled and rotated as part of the drill string 2 from surface by a drill rig. The force generator 11 also comprises a rotatable cam plate 13 disposed on and rotatable about a longitudinal cam shaft 14. Upon rotation of the shaft, a perimeter portion of the cam plate 13 rotates through and bears against a bearing assembly 15 (can be termed a "bearing") that longitudinally constrains the cam plate 13 at the point of contact (bearing surface). The cam plate is positioned at an oblique angle (e.g. "B") through and relative to the bearing assembly (and relative to the longitudinal axis of the drillstring). Hereinafter, reference to "oblique" is with reference to the longitudinal axis, bearing assembly or some other reference point. This oblique angle is achieved via either the cam plate 13 being disposed on the shaft 14 at an oblique angle and/or the cam plate having two opposed bearing surfaces 21*a*, 21*b* that are generally oblique (and preferably parallel) relative to the longitudinal shaft 14. A rotary input (e.g. shaft/motor 16) uphole in the drill casing 10 can be connected to the shaft 14 of the mechanical force generator, which can optionally be considered part of the mechanical force generator. A PDM, turbine or other motor or rotary drive uphole in the drill casing 10 can provide the rotary input. A mass 17 is connected directly or indirectly to the cam plate 13—for example, it is connected to the shaft 14.

As the cam plate 13 rotates about the shaft 14 and through the bearing assembly 15 (at the oblique angle), the oblique angle of the cam plate oscillates shaft 14 and the mass 17 longitudinally "A" (preferably sinusoidally or near sinusoidally). This transfers an oscillation through the bearing assembly 15 through the force generator outer housing 12 to the drill housing 10. In a preferred embodiment, the mass 17 is connected to the centre of the cam plate 13, which oscillates the mass as the centre of the cam plate itself oscillates during rotation due to the oblique angle of the cam plate.

The bearing assembly 15 comprises bearing supports 18*a*, 18*b* with two opposed bearings 19*a*, 19*b* with respective bearing surfaces 20*a*, 20*b* that bear against respective bearing surfaces 21*a*, 21*b* of the cam plate. The opposed nature of the bearings 19*a*, 19*b* constrains longitudinally the cam plate 13 at the point of contact 20*a*/21*a*, 20*b*/21*b* of the bearings/cam plate bearing surfaces. The bearing surface 20*a*, 20*b* of at least one (and preferably both) of the bearings 19*a*, 19*b* adapts/adjusts to follow the respective bearing surface 21*a*, 21*b* of the cam plate to maintain engagement with that bearing surface on the cam plate as it rotates. Preferably, each bearing 19*a*, 19*b* takes the form of a cam follower or other moveable component that follows/tracks the corresponding bearing surface 21*a*, 21*b* of the cam plate.

Figure 2:
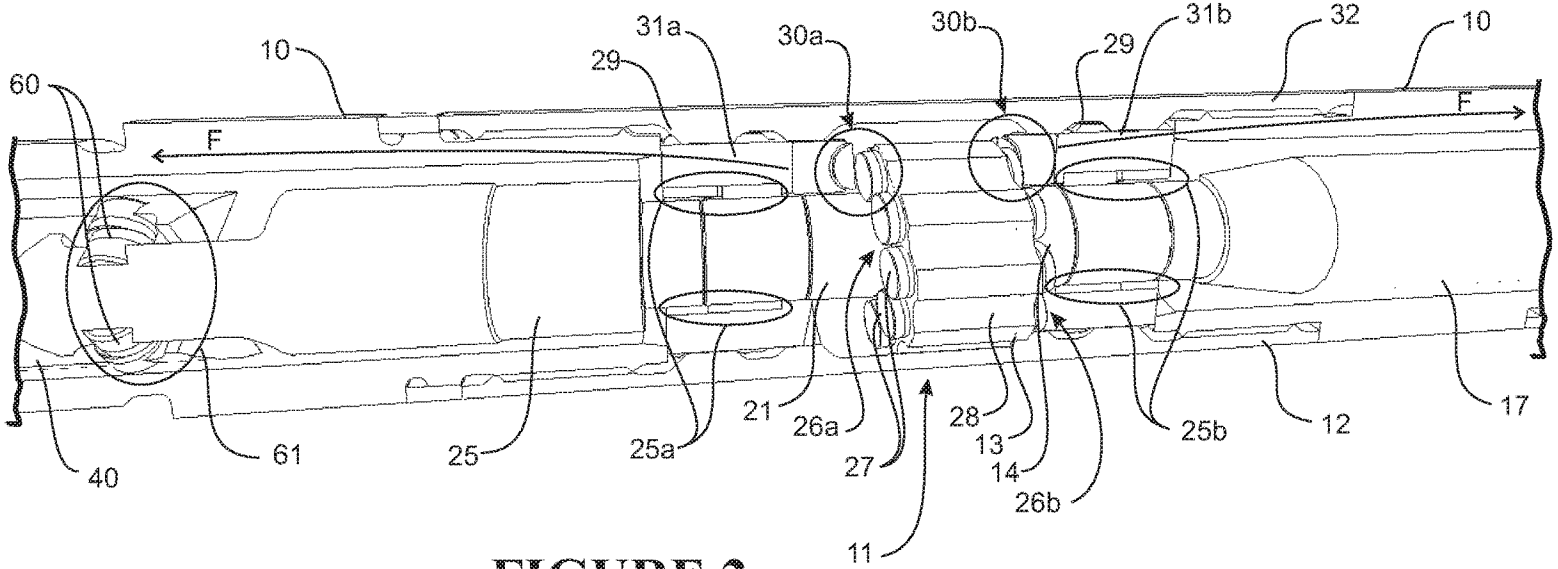
FIGS. 2, 4, 5 show a first embodiment of a mechanical force generator in a drill string in partial cross-section.
Figure 3:
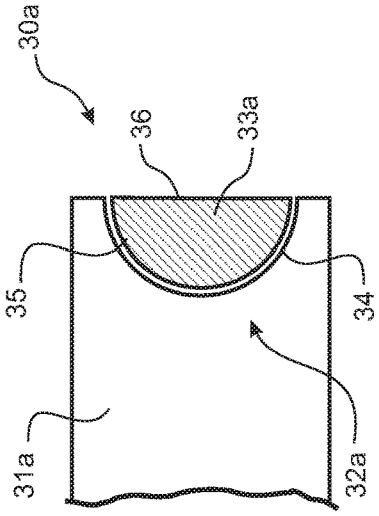
FIG. 3 shows a knuckle bearing of the force generator in more detail.
Figure 4:
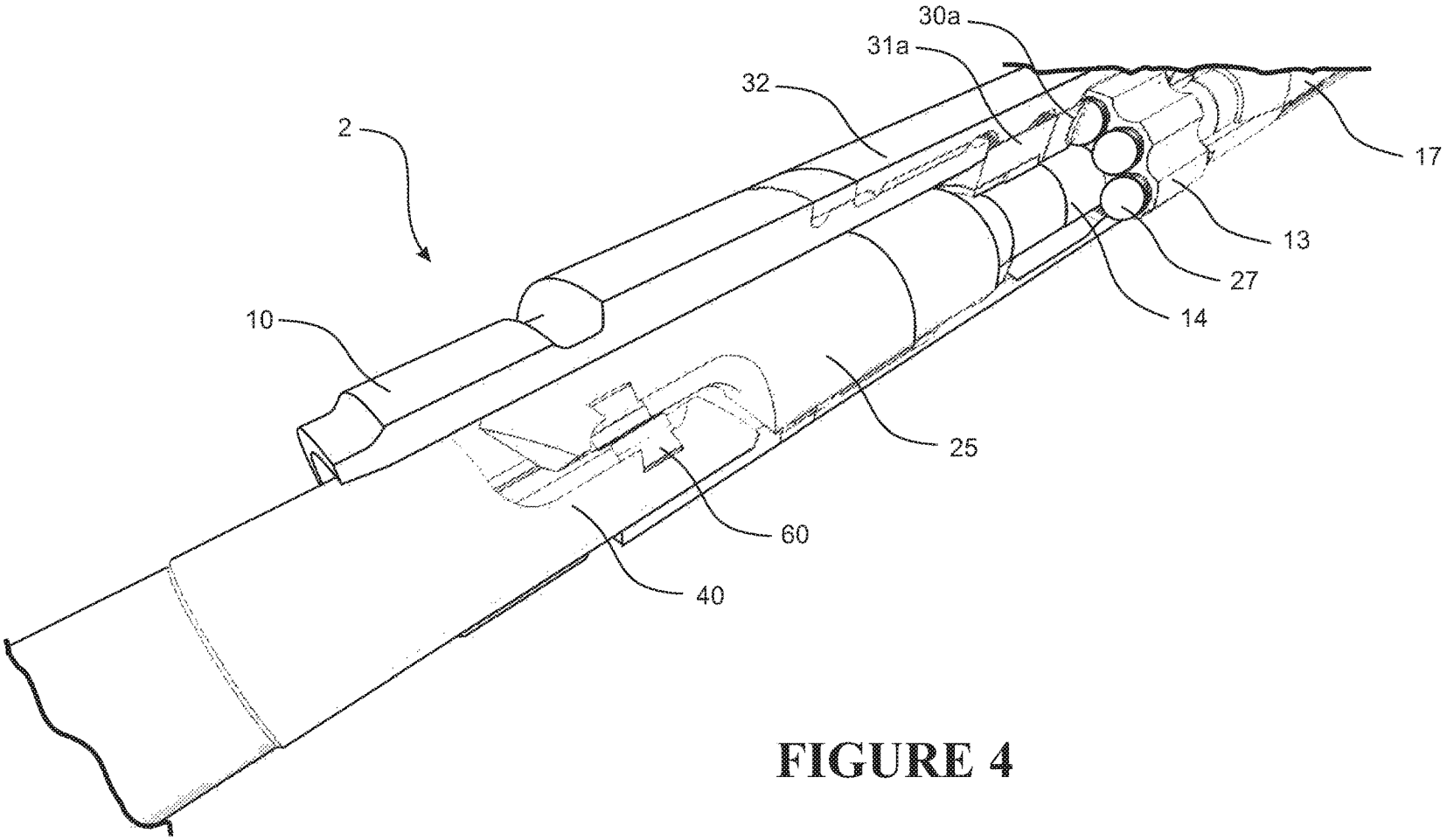
Figure 5:
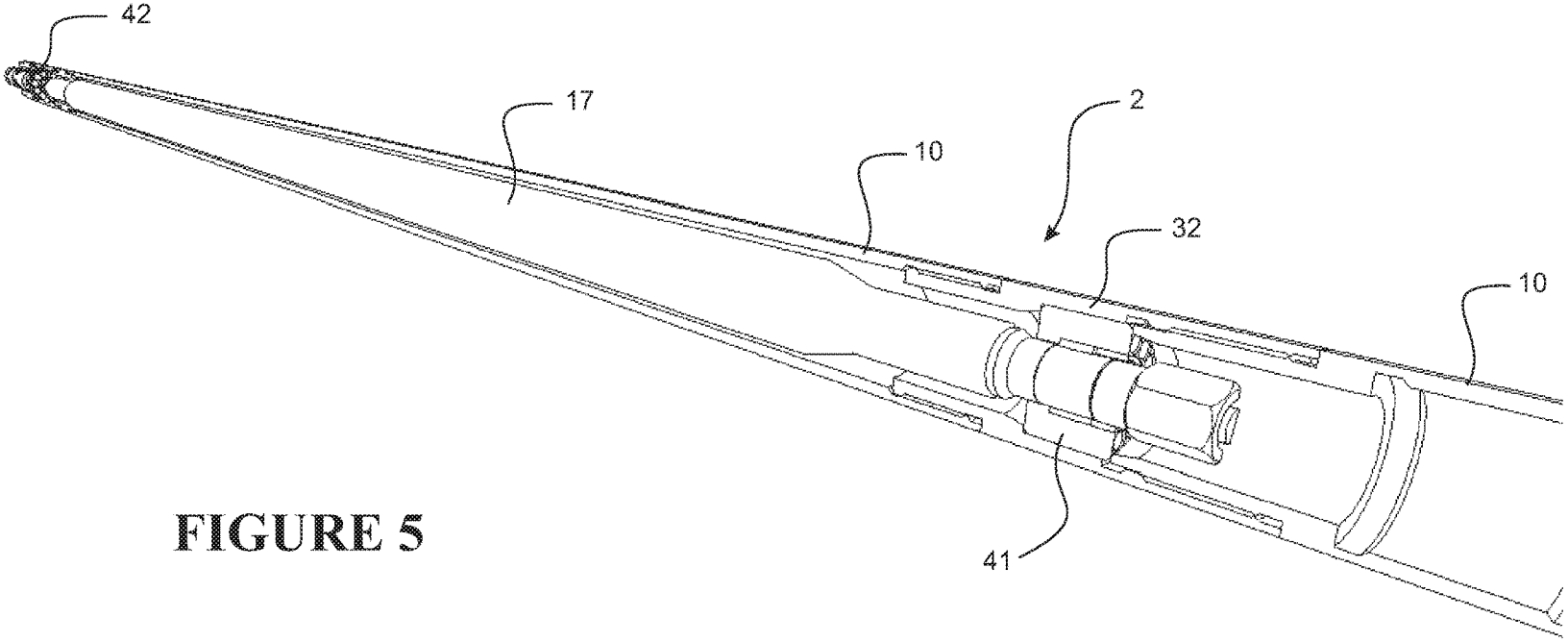

FIGS. 2 to 5 show one example embodiment of a mechanical force generator 11 connected to a drillstring housing 10 in partial cross-section. FIG. 5 shows generally a lower portion of the overall drillstring 2 comprising the housing 10, mechanical force generator 11 with mass 17 and drill bit 42. Referring to FIG. 2, the force generator 11 preferably comprises an outer tubular housing 12 which is connected to the drill string 2/drill string housing 10, and is advanced/pulled and rotated as part of the drill string from surface by a drill rig. The mechanical force generator also comprises a cam plate 13 disposed on a rotatable cam shaft 14 at an oblique angle. The rotatable shaft is disposed coaxially within the outer housing 12. A mass 17 is coupled directly or indirectly to the cam plate/shaft on one (downhole) side. A rotary input shaft 25 is also coupled directly or indirectly to the cam shaft 14/cam plate 13 on the up hole side. The cam shaft 14 and/or rotary input 25 and/or mass 17 (or part thereof) extend through concentric shaft bearings (also termed "constraining bearings") 25*a*, 25*b* that are disposed in the drill housing 2/10. The concentric shaft bearings 25*a*, 25*b* assists the shaft 14 to remain centrally aligned (concentric to casing) so that it does not wobble, flex/bend during rotation of the oblique cam plate. The rotary input shaft 25 is splined 61 to an output shaft 40 from a rotary source/drive such as a PDM, turbine or other motor or rotary drive (this can be seen in more detail in FIG. 4). This allows rotation of the rotary input shaft 25 (and hence the cam shaft 14 and the cam plate 13), while still allowing for longitudinal oscillation of the rotary input shaft as the cam plate wobbles and creates longitudinal oscillation. This splining isolates the rotary drive from the oscillation of the rotary input shaft. As shown, the spline comprises bearings 60 to allow rotation of the rotary input shaft 25 and output shaft 40 from the rotary drive, while still allowing axial movement. In an alternative, the rotary drive could be a sliding torque drive, in which case no spline is required.

The cam plate 13 has two opposed surfaces (obscured) and on each surface an opposed bearing surface 26*a*, 26*b*. Each bearing surface 26*a*, 26*b* comprises a plurality of flat PCD diamond bearing elements e.g. 27. The cam plate can comprise circumferential scallops e.g. 28 allowing flow of drilling fluid through and past the mechanical force generator.

The cam plate 13 (and the opposed bearing surfaces 26*a*, 26*b* thereof) are rotatable through a bearing assembly 29 comprising opposed bearings 30*a*, 30*b* (each in the form of a cam follower) supported on bearing supports (in this case in the form of bearing support plates) 31*a*, 31*b*. One bearing 30*a* is shown in more detail in FIG. 3. The bearing support plates 31*a*, 31*b* are rotationally and longitudinally constrained within the force generator housing 12, and are set apart by a distance to allow the cam plate to rotate between them on the bearings 30*a*, 30*b*. Each cam follower (bearing) takes the form of a knuckle joint/bearing (shown in more detail in FIG. 3) comprising a bearing housing in the form of a socket 32*a*, 32*b* and bearing element 33*a*, 33*b*. Each socket is coupled to or integrated with a respective bearing support plate 31*a*, 31*b*, and preferably has a concave shaped bearing surface 34 (such as dome or hemisphere). Each socket is preferably formed in/from PCD diamond. Each bearing element 33*a*, 33*b* takes the form of a PCD diamond hemispherical/domed bearing (also termed "cam follower"), with a first slidable convex bearing surface 35 that is received in and slides against the concave socket 34, and a second flat slidable bearing surface 36 that bears against a corresponding bearing surface 27/bearing element 26*a* of the cam plate. The domed bearing insert 33*a* is preferably made from PCD diamond. The synthetic diamond materials (PCD or similar) have extremely high Pressure Velocity (PV) limits even when used with abrasive/contaminated fluids.

The cam plate 13 and bearing surfaces 26*a*, 26*b* are sandwiched between the knuckle joints/bearings 30*a*, 30*b* and at the point of contact the cam plate 13 is longitudinally constrained by way of the bearing support plates 31*a*, 31*b* which are themselves also longitudinally constrained. As the cam shaft 14 rotates, the cam plate/bearing surfaces rotate through the bearing assembly 29. Each cam follower (knuckle joint) 30*a*, 30*b* bears against a successive bearing element 27 of the bearing surface 26*a*, 26*b* of the cam plate. As it does so, the respective domed bearing element (cam follower) e.g. 33*a* slides/pivots/rotates within the corresponding socket 34 so that the flat second slidable bearing surface 36 of the cam follower 33*a* adapts to and maintains contact with the bearing surface 26*a*, 26*b* of the cam plate currently in contact. Because of the oblique nature of the bearing surfaces 26*a*, 26*b* of the cam plate, the angle of the surface passing through the bearing at any time will change. The domed bearing element (cam follower) 33*a* pivots to adapt further such that the flat surface 36 is always in contact with and maintains engagement with the bearing surface 26*a*, 26*b* of the cam plate (and in particular the successive bearing elements 27 of the bearing surface 26*a*, 26*b*). As the cam plate 13 rotates about the shaft and through the bearing assembly 29 (at the oblique angle), the oblique angle of the cam plate oscillates shaft 14 and the mass 17 longitudinally (preferably sinusoidally or near sinusoidally). In a preferred embodiment, the mass 17 is connected to the centre of the cam plate 13, which oscillates the mass as the centre itself oscillates during rotation due to the oblique angle of the cam plate.

It will be appreciated that the bearing surfaces 26*a*, 26*b* could take any suitable form and do not necessarily have to comprise individual flat PCD diamond bearings 27. For example, the bearing surface could be a single contiguous surface and/or could be constructed using any suitable bearing material.

The oscillating mass 17 creates a sinusoidal or near sinusoidal oscillating output that is transferred through the bearing support plates 31*a*, 31*b* to the drill casing 10. The bearing elements 30*a*, 30*b* also act as a thrust surface in each direction—that is one bearing element bears 30*a* the resultant thrust force of the shuttle in one direction—the other bearing element 30*b* bears the resultant thrust force of the shuttle as it oscillates in the opposite direction. As the shuttle oscillates back and forth, the longitudinal oscillating force "A" generated is managed with PCD bearings, these provide the vibrational impulses generated by the force generator out and along to the outer casing 10 (as per arrows "F"). The forces travel considerable distances in the drill housing both upwardly and downwardly giving the desired benefits to drilling as previously mentioned. The bearing elements 30*a*, 30*b* and concentric shaft bearings 25*a*, 25*b* are lubricated by the drilling fluid used to operate the drill string and force generator, and have the same beneficial abrasive resistant and high PV limits mentioned earlier.

The centre of the rotary shaft 14 may be hollow (bored), which enables and/or allows the majority of the drilling fluid to be pumped to a drill bit (or other tooling) down hole of the mechanical vibratory device. As will be understood, the output force and frequency can be controlled by manipulating the fluid flow being pumped through the device, where more flow will give higher frequency of vibrational output and greater output force. The output characteristics can also be manipulated at the design phase—adding greater mass to the shuttle will give greater force while manipulating the wobble plate angle (to a degree) can also alter the output signal.

As durable as PCD diamond materials are, they do require a degree of lubrication-primarily to limit extreme temperature build up. The lubrication in this instance is provided by ports that carry the drilling fluid down the drill string to the drill bit at the end of the string (or other tooling) with some working fluid allowed to enter the force generator for lubrication purposes. It will be clear that when the rotationally constrained mass 17 oscillates back and forth a thin film of the drilling fluid will move between the concave and convex diamond surfaces to provide lubrication and to control frictional temperature build up.

Where PCD is mentioned as a bearing material, it will be appreciated that this is preferred but not essential. The above embodiments could be constructed using any suitable bearing material.

The embodiments above describe a single force generator. It will be appreciated that multiple mechanical force generators as described could be connected to a drill casing to provide additional oscillating force.

Optionally, and preferably, the mechanical force generator can be used in conjunction with one or more of the following downhole applications:

- Tractoring including but not limited to items such as a drill string and/or tools into a bore.
- Extended reach drilling.
- Shifting valves.
- Setting plugs.
- Setting screens.
- Sand control in screens.
- High Pressure High Temperature applications.
- Stirling engine pump.
- Milling.
- Scale removal.
- Cementing.
- Core sampling.
- Drilling.
- Fishing for stuck tools.
- Used in wire line applications.

Mechanical Force Generator Used in a Core Sampling Apparatus

An example of how the mechanical force generator described above can be used for in an apparatus for core sampling will now be described. This is a non-limiting example—the mechanical force generator can be used in any drilling or other downhole apparatus where oscillation is required.

During core sampling (typically for mineral exploration) a high speed diamond drill is used. During this process the diamond drill rotates thin walled drill rods (casing) from surface at high speed often >1000 rpm—at the distal end of the drill rods is a diamond core drill bit—which has a hollow centre. As the drill bit is rotated and pushed forward into the formation being drilled, the core sample moves into an annulus above the drill bit known as a core barrel, typically the core barrel is 1.5-6 meters long.

Once the drill bit has advanced sufficiently for the core barrel to be full the drilling stops and from surface a wire cable and overshot is lowered down thru the drill rods until the overshot attaches to the core barrel (and associated components) the wireline is then retracted to surface pulling the core barrel and core (which is retained by a snap ring or similar). The core can then be removed from the bore for analyses whilst the drill rods and bit remain in the ground acting as a temporary casing.

While diamond core drilling is the industry standard for taking rock samples, there are problems. The core sample will often break and block the core barrel. This means that when the wireline is raised to surface for the inner assembly (core barrel, core sample swivel, latching system etc), it transpires that the core barrel is only partially full (at best), or in fact the rock core has wedged in such a way as to stop further advancement of the drilling system. Diamond core drilling is slow and expensive, with the core being recovered often at a rate of 20 meters or less per 12 hour shift, in extremely hard formations the drilling may cease.

In an embodiment, a core sampling apparatus 60 is provided comprising a mechanical force generator 11 as described above that can minimise the problems above associated with traditional core sampling apparatus. This apparatus can provide controllable vibration during core sampling to improve the drilling operation outcome. For example, the apparatus can ease the core into the barrel, increasing the rate of production by for example enabling increased oscillation to the bit thereby increasing the ability of the bit to cut the bore face, and/or preventing breaching of the core within the barrel. As described previously, the vibration can be controlled at surface by controlling the force (amplitude) and frequency via the drilling fluid flow and/or pressure of the same as it flows through the rotary input such as a PDM, turbine or the like. In some instances the force may be maintained and the frequency is increased to cause the bit to oscillate faster or in other instances the frequency may be maintained and the force is increased to maintain the rate of production. Having the ability to control the vibration enables the invention to be used for a variety of terrain and to allow the user to modify the same during operation in situ.

Figure 6:
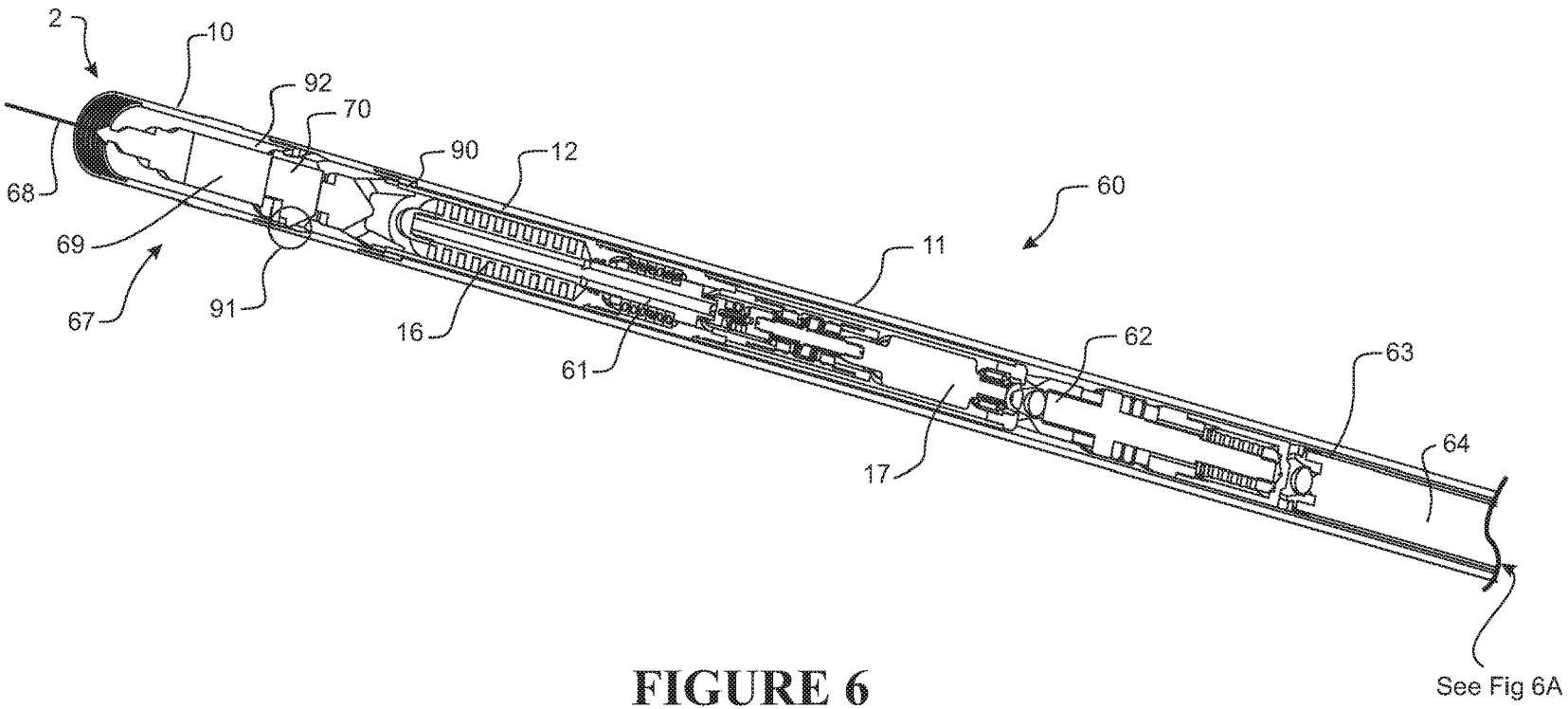
FIGS. 6, 6A, and 7 show in perspective and elevation views respectively, an embodiment of a core sampling drilling apparatus incorporating a mechanical force generator.
Figure 6A:
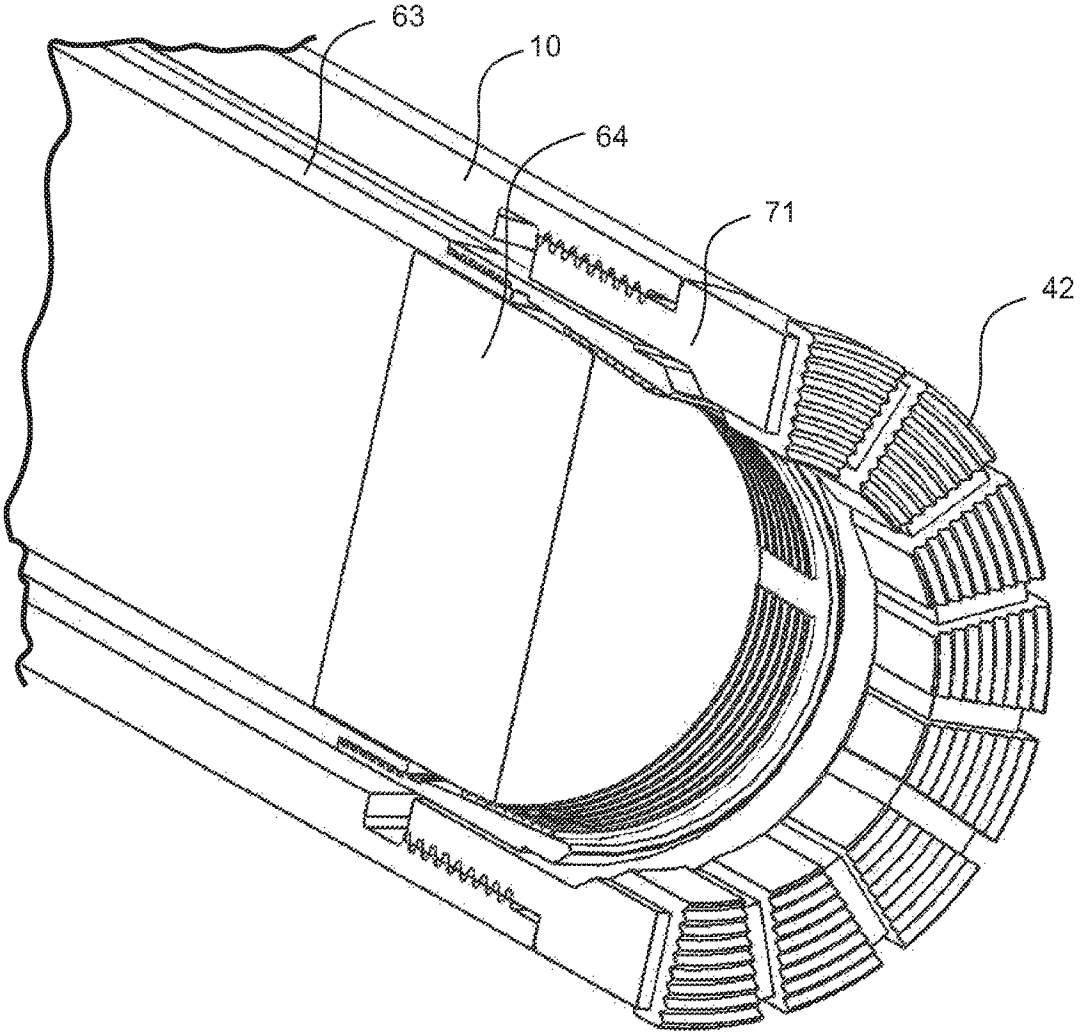
Figure 7:
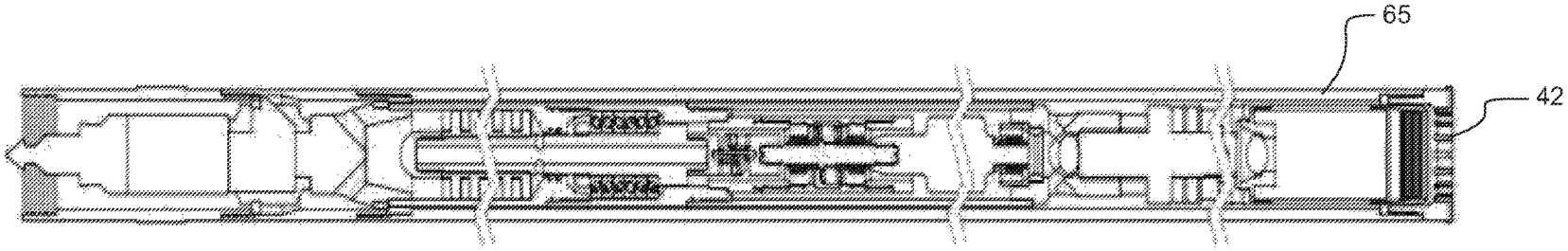

Referring to FIGS. 6, 6A and 7, the core sampling apparatus 60 comprises an outer casing 10 formed from a plurality of drill rods coupled together (e.g. through threading). The outer casing is or forms part of a drill string 2. FIG. 6A shows the end portion of the apparatus in FIG. 6 that is dotted out. The outer casing 10 is rotated by an up hole drilling apparatus. A mechanical force generator 11 with an outer tubular housing 12 is coupled to the outer casing 60. The outer tubular housing 12 is coupled to the outer casing 10 by threading or other coupling means. The outer tubular housing comprises a mechanical force generator 11 as previously described with reference to FIGS. 1 to 5. The outer tubular housing 12 also comprises a rotational apparatus 16 to provide rotational input that connects to and rotates a rotational shaft (including input shaft, output shaft and/or cam shaft 14) of the mechanical force generator to operate the mechanical force generator 11. In this embodiment, the rotational input to the mechanical force generator is provided by any suitable rotational apparatus, such as a compact fluid powered turbine (as shown) or a positive displacement motor (PDM). In another embodiment, it could also be an electric motor, such as described in relation to FIG. 11. A bearing section 61 is provided between the rotational apparatus 16 and mechanical force generator 11. The bearing section 61 keeps the assembly concentric and manages the thrust loads that the drilling fluid (to be described with reference to FIG. 9) and rotational apparatus generate. A ballast (mass) 17 (see e.g. FIG. 6) is provided, which can be configured with a material and length to provide the required force (amplitude) from the mechanical force generator 11.

The outer tubular housing 12 also comprises a section swivel 62, which couples between the mechanical force generator 11 and a core sampler barrel 63 and core catcher 71 (see FIG. 6A, which shows the dotted portion at the end of the apparatus in FIG. 6 in detail). The section swivel 62 isolates the rotation of the rotational apparatus 16/mechanical force generator 11 from the core barrel 63. This allows the core sampler barrel 63 to rotate relative/independently to the mechanical force generator 11 and to isolate the core sample 64 in the barrel 63 from rotation that may damage the core sample 64. The swivel section 62 also incorporates a spring loaded seal system commonly used in the industry. Generally the spring loaded seal system causes a fluid pressure change when the core barrel 63 is full of core 64, which the driller at the surface uses to cease drilling and to recover the core by wireline in a manner to be described in relation to FIGS. 8 to 9. The core sampler 63 is coupled between the section swivel 62 and a bit box 65 with a drill bit 42 (see FIG. 6A) coupled to the end of the apparatus 60.

To extract a core sample 64, that has been obtained via drilling, the apparatus 60 is adapted to receive an extraction sub-assembly 67 that is lowered through the centre of the outer casing 10 using a cable wire 68. The extraction sub-assembly comprises a wireline assembly 69 coupled to an overshot 70. As the extraction sub-assembly is lowered into the casing 10, the overshot 70 engages with the removable coring sub-assembly components down hole of the outer casing (comprising the rotational apparatus 16, bearing section 61, mechanical force generator 11, ballast 17, swivel section 62 and core barrel 63) to retract them up hole from the outer tubular housing 12 through the outer casing 10.

Figure 8:
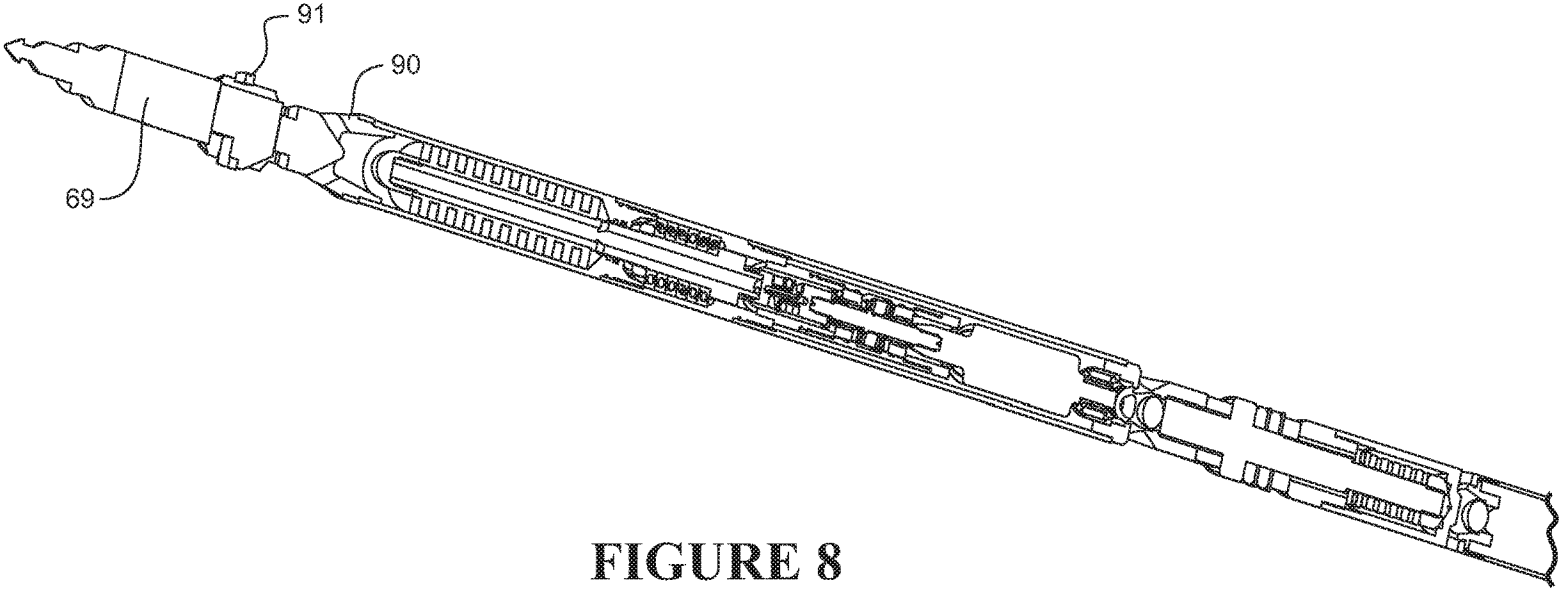
FIG. 8 shows in perspective view a sub-assembly with a core barrel and core sample removed from the core sampling drilling apparatus.

FIG. 8 shows the extracted removable sub-assembly, after it has been removed from the outer casing 10 and outer tubular housing 12.

Referring to FIG. 6, as the extraction sub-assembly 67 is lowered into the drill rods (casing assembly) 10 the lower end of the overshot 70 comes to rest on a landing ring 90. A landing ring can be an annular abutment, for example. The landing ring controls how far the overshot 70 assembly will fall into the casing 10. At the upper end of the overshot is a spring loaded portion 91 (latches), which snaps against another abutment 92 of the wireline assembly 69. As well as securely holding the extraction sub-assembly 67 in place during drilling, both the upper 92/91 and lower abutments 90 (that is, the latches 91 and landing ring 90) also provide a pathway through the casing (drill rods) 10 and drill bit 66 (as well as indirectly to the core barrel 63) for the vibrational outputs from the mechanical force generator 11. For example, as the mechanical force generator shaft is rotated and the ballast is rotated and moved in a downward direction and then abruptly reversed—the associated impulse travels via the PCD bearing elements 33*a*, 33*b* and sockets 32*a*, 32*b* of the mechanical force generator 11 through the housing 12 surrounding the mechanical force generator 11 and rotational apparatus 16 up to the overshot 70 and via the lower landing ring 90 into the drill rods (casing) 10 and via the drill bit 66 into the formation.

When the ballast 17 is rotated and moved axially to the top of its stroke and then abruptly reversed in a downward direction the vibrational force travels via the up hole PCD bearing elements 33*a*, 33*b* and sockets 32*a*, 32*b* through the assembly casing 12 which surrounds the mechanical force generator 11 and rotational apparatus 16 to the overshot 70 and out through the overshot latches 91 to the casing abutment 92. It will be appreciated that at this upper abutment 92 there is a change in wall section 150 (more easily visible in FIG. 10) of the drill rods (casing) 11 that will cause a reversal of most of the upwardly moving impulse—so that in realty the direction of impulse via the mechanical force generator, whether originating in a downhole or up hole direction, results in downward energy pulses. This further means that the impulses generated are directed downwards to the bit. The inflection point may also protect sensitive up hole equipment from the pulses generated and can act as a reamer to maintain the gauge of the hole.

Figure 9:
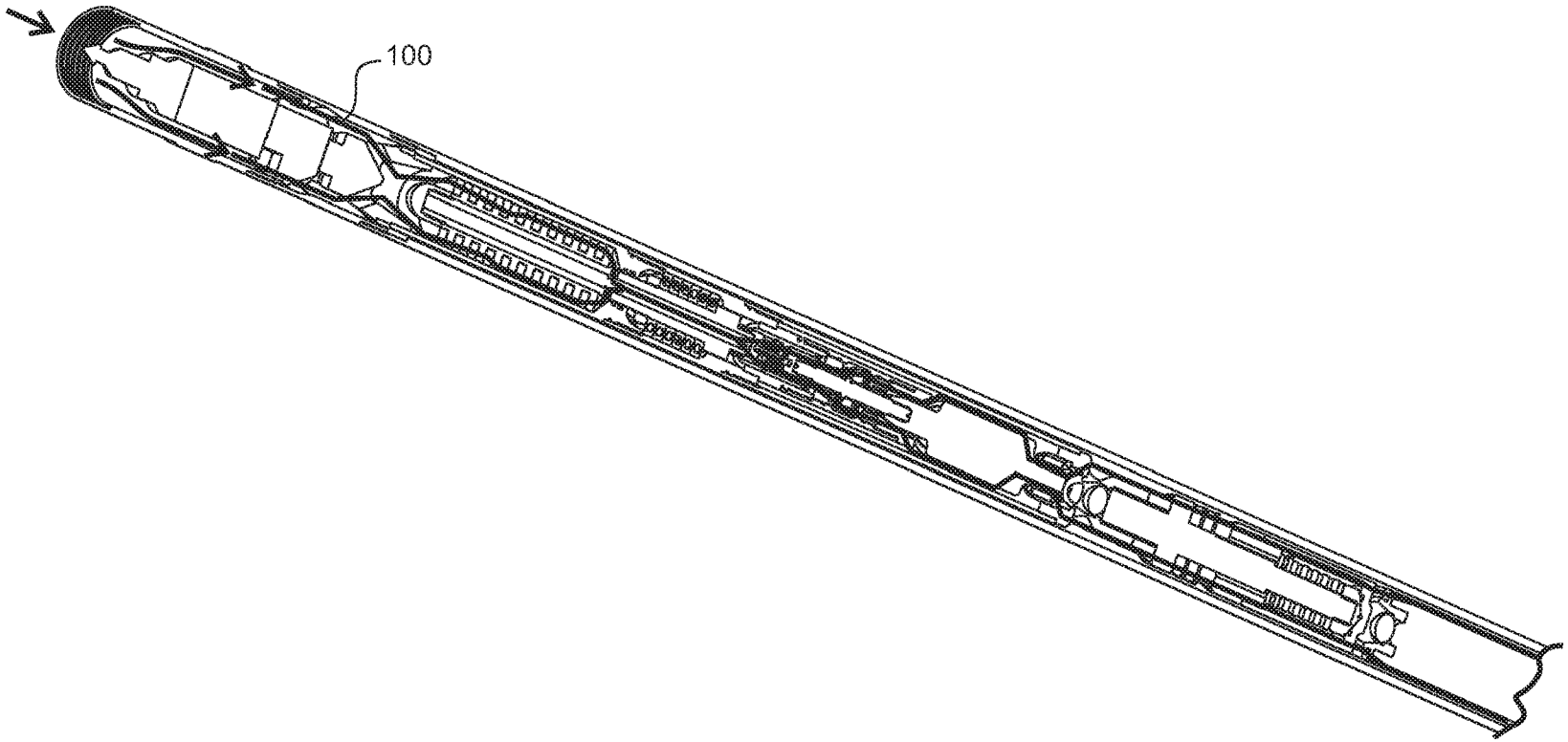
FIGS. 9 and 10 show in perspective and elevation views respectively a drill fluid path around/through the drilling apparatus.
Figure 10:
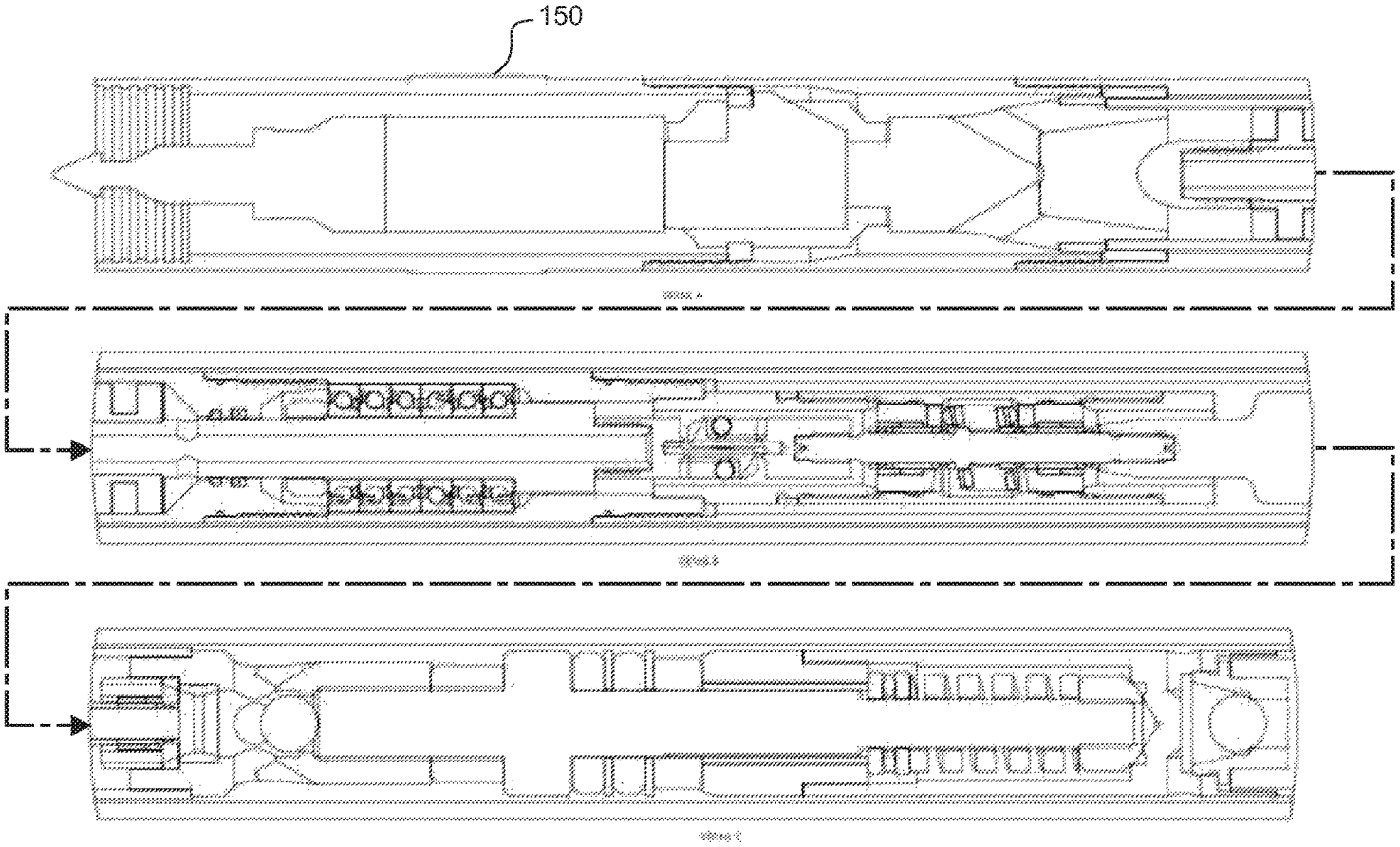

The apparatus 60, including the drilling and hammering operations, are effected by fluid flow 100 from the drilling fluid. FIGS. 9 and 10 show the drilling fluid flow path 100, by way of example. The hydraulic power is converted into a rotational mechanical output by the rotational apparatus (e.g. by a turbine, PDM or the like) and then flows over/through/around the mechanical force generator 11 thereby lubricating and cooling the PCD bearing (or similar) elements 33*a*, 33*b*. There are several ports, which change the directional flow as desired and ultimately travel to the bit via a slim cavity between the drill rods (casing) and the core barrel—avoiding possible damage or erosion to the core sample itself.

Mechanical Force Generator Used in Wireline Applications, for Example Wireline Logging Drilling Apparatus Wireline logging applications are often used in the energy exploration sector. Often while obtaining wireline logs (usually done while slowly pulling the logging tools from surface on a wireline) the logging tool suffers from stick slip, whereby the pulling force from the surface is constant and as the logging tool sticks, energy builds in the pulling cable until the logging tool jumps up hole and then re-sticks. This results in an uneven logging of the strata—which is not desirable. There may also be instances where the logging tool becomes stuck and irretrievable, resulting in considerable financial detriment.

Figure 11:
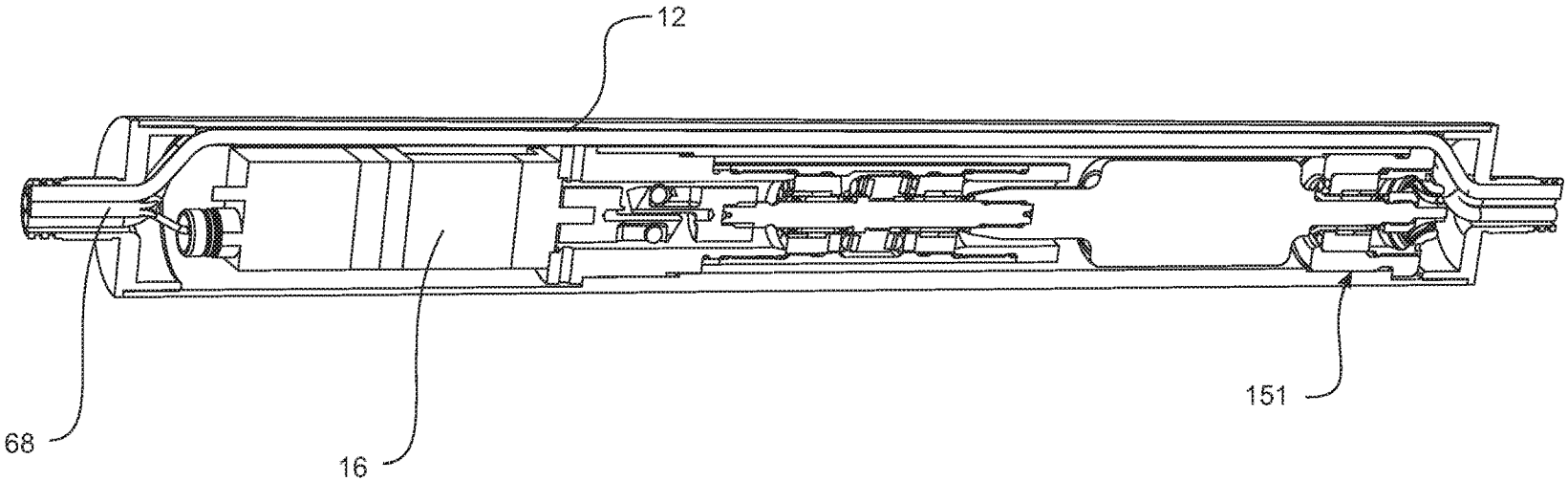
FIG. 11 shows an embodiment of a wireline logger incorporating a mechanical force generator, with an electric motor rotational apparatus power via the wireline that also incorporates an optional water pump.

Referring to FIG. 11, in another embodiment for another industry application, by way of example, the mechanical force generator can be utilised in drilling apparatus that incorporates wireline logging. In this embodiment, the rotational apparatus 16 is an electric motor with an optional water pump 151 incorporated into the apparatus to provide a fluid flow for cooling and lubrication. It will be appreciated that the rest of the apparatus can be the same as described in relation to FIGS. 6 to 11. The wireline cable 68 that deploys and retrieves a logging unit can be used as a conductor to power the electric motor 16, to provide the rotary input for the mechanical force generator 11. In this case, the lower portion (right hand side) of the outer tubular housing 12 is physically connected to the logging tool(s) so that the vibrational output from the mechanical force generator 11 reduces the likelihood that the logging tool will experience micro-sticking—and therefore provides superior data for the client.

In a variation, it can be beneficial to provide a reverse flow pump (or similar) on the rotational end of the ballast 17 to provide a flow of cooling fluid (present in the bore hole being logged) over/through and around the PCD (or similar) components.

The present invention has various advantages. For example, it can:

Be engaged as and when necessary.

Generate sufficient force to minimise friction—and/or free stuck drill strings.

Allow a substantially unrestricted fluid path through the length of the tool for drilling fluids, lost circulation medium etc.

Have a controllable level of force and/or frequency, from gentle to strong-adjustable as required from surface.

Can operate in harsh environments requiring little or no maintenance.

Can be used in various applications as outlined above.

In addition to the above the device could also be used as a seismic signal generator, or used for settling cement, or any other application where an axial excitation is useful.

The substantially sinusoidal vibrations travel long distances along the drill string, coil tube or other housing to help prevent problems such as differential sticking due to a build-up of drill cuttings and helical buckling in coil tube pipe. In addition, the vibratory output assists with maintaining weight on bit (WOB) when drilling, which can increase the speed of drilling as well as extending drill bit life. The structure of the mechanical force generator described improves manufacturability, simplicity and reliability.

The invention can provide an "on demand" capability downhole whereby, as and when wanted, a mechanical force generator or excitation device can be activated.

The PCD (Poly Crystalline Diamond) bearings are extremely tough and abrasion resistant, so this reduces the need to keep a clean lubricating fluid (which would otherwise be required with more conventional roller bearings) separate from the bore hole drilling fluid. This also means there is no (or reduced) requirement for any static or dynamic seals, or pressure compensation systems to account for entrained air or varying thermal expansions rates of different fluids. Alternatively, the PCD bearings may be substituted with other hard wearing materials.

Given the advantages outlined above—the embodiments described lend themselves to a very simple design which is always advantageous when it comes to reliability. There are few moving parts to cause failure, and in addition there are no (practical) temperature limits meaning this is useful in High Pressure High Temperature applications (HPHT).

The invention claimed is:

1. A mechanical force generator for use in a drillstring that provides an oscillating output, comprising:

a rotatable cam plate, that in use is rotated by a rotatable drive, connected to oscillate a mass so that in use the cam plate and mass indirectly provide oscillations to the drillstring and/or a housing of the drillstring, the cam plate having two opposed oblique bearing surfaces rotatable through a bearing, the bearing comprising at least one opposing knuckle bearing for each opposed oblique bearing surface, each knuckle bearing comprising a socket and corresponding bearing element with a first slidable bearing surface within the socket, and a second slidable bearing surface that bears against a corresponding opposed bearing surface, wherein upon rotation, the two opposed oblique bearing surfaces cam against the bearing to oscillate the mass longitudinally relative to the drillstring and/or the housing of the drill string, the oscillations being indirectly transferred to the drill string and/or drillstring housing.

2. The mechanical force generator according to claim 1 wherein for each knuckle bearing, the bearing element pivots in the socket so the second slidable bearing surface follows and maintains engagement against the opposed oblique bearing surface during rotation.

3. The mechanical force generator according to claim 1 further comprising a rotary input shaft for rotating the cam plate.

4. The mechanical force generator according to claim 3 wherein the opposed oblique bearing surfaces are parallel and arranged non-perpendicular to the longitudinal axis of the rotary input shaft such that the longitudinal displacement of each opposed surface with respect to the axis varies across the surface.

5. The mechanical force generator according to claim 3 wherein the cam plate comprises a flat plate with opposed parallel surfaces to form the oblique bearing surfaces, the cam plate being coupled to the shaft at an angle such that the opposed oblique bearing surfaces are arranged non-perpendicular to the longitudinal axis of the shaft.

6. The mechanical force generator according to claim 1 wherein the opposed bearing surfaces are flat.

7. The mechanical force generator according to claim 1 wherein the cam plate comprises opposed parallel surfaces formed at an oblique angle to form the oblique bearing surfaces such that the opposed oblique surfaces are non-perpendicular to the longitudinal axis of the shaft.

8. The mechanical force generator according to claim 1 wherein the socket and/or bearing element are formed from PCD diamond.

9. The mechanical force generator according to claim 1 wherein the socket is concave and the first slidable bearing surface is correspondingly convex.

10. The mechanical force generator according to claim 1 wherein the back and forth movement of the mass transfers a force to an outer casing via thrust bearings.

11. The mechanical force generator according to claim 1 wherein as the cam plate rotates, it slides against the bearing and the bearing element swivels in the socket so that each knuckle bearing maintains contact with a corresponding oblique bearing surface.

12. The mechanical force generator according to claim 1 wherein the interface between the socket and bearing element is lubricated with drilling fluid.

13. The drillstring and/or drilling apparatus comprising the mechanical force generator according to claim 1.

14. The mechanical force generator as claimed in claim 1 further comprising a tubular housing for integration and use in or with a drill string, the mechanical force generator being operable to provide oscillations to an outer casing of the drillstring in one or more of the following applications by:

when tractoring into a bore, oscillating the drillstring to assist with progress through the bore;

in extended reach drilling using a drill bit coupled to the drillstring, oscillating the drillstring to avoid the drillstring sticking in the bore and to provide extended reach drilling;

when core sampling using a coring apparatus with the drillstring, oscillating the outer housing of the drillstring to progress core sampling;

wherein the mechanical force generator and drill string assembly are used in variable temperature and/or pressure applications.

15. The mechanical force generator as claimed in claim 1 further comprising a tubular housing for integration and use in or with a drill string, the mechanical force generator being operable to provide oscillations to an outer casing of the drillstring to improve operation in one or more of the following applications by:

when tractoring into a bore, oscillating the drillstring to assist with progress through the bore;

in extended reach drilling using a drill bit coupled to the drillstring, oscillating the drillstring to avoid the drillstring sticking in the bore and to provide extended reach drilling;

when core sampling using a coring apparatus with the drillstring, oscillating the outer housing of the drillstring to progress core sampling;

wherein the mechanical force generator and drill string assembly are used in variable temperature and/or pressure applications.

16. A drillstring and/or drilling apparatus comprising the mechanical force generator according to claim 1.

17. A mechanical force generator for use in a drillstring that provides an oscillating output, comprising:

a rotatable cam plate, that in use is rotated by a rotatable drive, connected to oscillate a mass to indirectly provide oscillations to the drillstring and/or a housing of the drillstring, the cam plate having two opposed oblique bearing surfaces rotatable through a bearing, the bearing comprising at least one opposing knuckle bearing for each opposed oblique bearing surface, each knuckle bearing comprising a socket and corresponding bearing element with a first slidable bearing surface within the socket, and a second slidable bearing surface that bears against a corresponding opposed bearing surface, wherein upon rotation, the two opposed oblique bearing surfaces cam against the bearing to oscillate the mass longitudinally relative to the drillstring and/or the housing of the drill string, the oscillations being indirectly transferred to the drill string and/or drillstring housing, wherein the interface between the socket and bearing element is lubricated with drilling fluid.

18. A wireline retrievable core sampling drilling subassembly for a core sample drilling apparatus comprising:

a wireline extraction sub assembly comprising:

a wireline assembly, and an overshot with a latch to couple to the drilling apparatus, the mechanical force generator as claimed in claim 1, a rotational apparatus to operate the mechanical force generator, a core barrel, and a swivel for coupling the mechanical force generator and core barrel.

* * * * *